US007438574B2

(12) United States Patent
Neumann

(10) Patent No.: US 7,438,574 B2
(45) Date of Patent: Oct. 21, 2008

(54) ISOLATED DUAL AC-DC PLUG

(75) Inventor: Peter W. Neumann, Chicago, IL (US)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 11/361,548

(22) Filed: Feb. 24, 2006

(65) Prior Publication Data

US 2007/0202724 A1 Aug. 30, 2007

(51) Int. Cl.
*H01R 29/00* (2006.01)

(52) U.S. Cl. ..... 439/172

(58) Field of Classification Search ..... 439/172, 439/501, 638, 502, 49, 504, 639, 623, 624, 439/131, 170–171, 173–175, 956, 521; 173/53; 320/112, 56, 2, 107, 111, 138; 363/146, 363/142, 147; 307/18, 21, 22, 23, 27
See application file for complete search history.

(56) References Cited

U.S. PATENT DOCUMENTS

| | | | | |
|---|---|---|---|---|
| 4,543,624 | A | 9/1985 | Rumble | |
| 4,997,381 | A | 3/1991 | Oh | |
| 5,599,204 | A * | 2/1997 | Glassford | 439/502 |
| 5,634,806 | A | 6/1997 | Hahn | |
| 5,713,749 | A | 2/1998 | Wu | |
| 5,829,993 | A | 11/1998 | Wu | |
| 5,847,545 | A | 12/1998 | Chen et al. | |
| 5,967,807 | A | 10/1999 | Wu | |
| D456,349 | S | 4/2002 | Chuang | |
| 6,464,519 | B1 * | 10/2002 | Hawks | 439/172 |
| 6,923,688 | B1 | 8/2005 | Burson et al. | |
| 6,936,936 | B2 | 8/2005 | Fischer et al. | |
| 7,011,538 | B2 * | 3/2006 | Chang | 439/172 |
| 7,012,403 | B2 * | 3/2006 | Hwang | 320/107 |
| 2004/0073820 | A1 | 4/2004 | Hsu | |

* cited by examiner

*Primary Examiner*—Edwin A. León
(74) *Attorney, Agent, or Firm*—Greer, Burns & Crain, Ltd.

(57) ABSTRACT

Various embodiments of the present invention are directed to electrical plug apparatus for selectively connecting a device such as a battery charger, for example, to sources of AC and DC electrical power and comprise a housing, a first connector attached to the housing for connecting to a DC source of electrical power, a second connector attached to the housing for connecting to an AC source of electrical power wherein the first and second connectors are configured to enable only one of the connectors to be used at the same time.

15 Claims, 4 Drawing Sheets

ISOLATED DUAL AC-DC PLUG

BACKGROUND OF THE INVENTION

The present invention generally relates to electrical connecting devices.

There has been a proliferation of electrical tools and devices that are powered by batteries or can be plugged into common electrical outlets, with the latter capability requiring an AC to DC power conversion device. If a device is essentially DC powered, it may be connected directly to a battery or source of DC power or it may have a converter and be connected to a converter to an AC power outlet.

A common source of DC power is provided by motor vehicles through a cigarette lighter socket receptacle or similar auxiliary receptacle that is connected to the DC battery of the motor vehicle itself. If that type of source is used, a DC plug may be provided to connect a device directly to the socket to power for the device of interest. If it is to be powered by converted AC power, then a common two or three prong plug must be provided which is interconnected to an AC to DC converter for providing the DC voltage necessary to run the device. Many products currently commercially available include multiple devices that can be used for connecting to AC and DC sources, which requires the user to carry both kinds of connectors if they wish to use either type of power source.

It should be appreciated that a device that can be connected to such AC and DC sources should be designed in a manner whereby it is not possible to simultaneously connect both sources to a device for the obvious reason that internal circuitry could be destroyed or significantly damaged. Also, such a condition could present a safety hazard to a user. Plugs have been designed with adjustable configurations that can be used for different types of sockets that are found in different countries of the world, including configurations that are adapted to plug into standard electric AC outlets as well as DC cigarette lighter sockets contained in single housing. All of such known configurations are not designed to be completely foolproof in the sense that they could not be simultaneously connected to AC and DC sources.

SUMMARY OF THE INVENTION

Various embodiments of the present invention are directed to electrical plug apparatus for selectively connecting a device such as a battery charger, for example, to sources of AC and DC electrical power and comprise a housing, a first connector attached to the housing for connecting to a DC source of electrical power, a second connector attached to the housing for connecting to an AC source of electrical power wherein the first and second connectors are configured to enable only one of the connectors to be used at the same time.

DETAILED DESCRIPTION

Various embodiments of an electrical connecting plug are shown which are configured to selectively connect a device, such as a battery charger for power packs of portable tools, for example, to electrical power sources. Such an electrical connecting plug may be connected to a source of DC power as well as an AC source. In the case of connection to an AC source, the connecting plug is typically connected to an AC to DC converter since most power tools are powered with DC motors. While there are commercially available devices having plugs that can be connected to either AC or DC sources, such known devices are not designed and configured to absolutely prevent both of the connectors from being connected to power sources at the same time. In the event that such a condition were to develop, it is highly likely that associated electrical circuitry could be damaged or destroyed. Such a condition could also create a safety hazard to the user or to anyone in the vicinity of the device.

The preferred embodiments that are described herein typically have a cylindrical DC connector of the type that fits within a cigarette lighter socket or similar type of socket that is provided in motor vehicles, boats, and other apparatus, such as portable power generators and the like.

Figure 1:
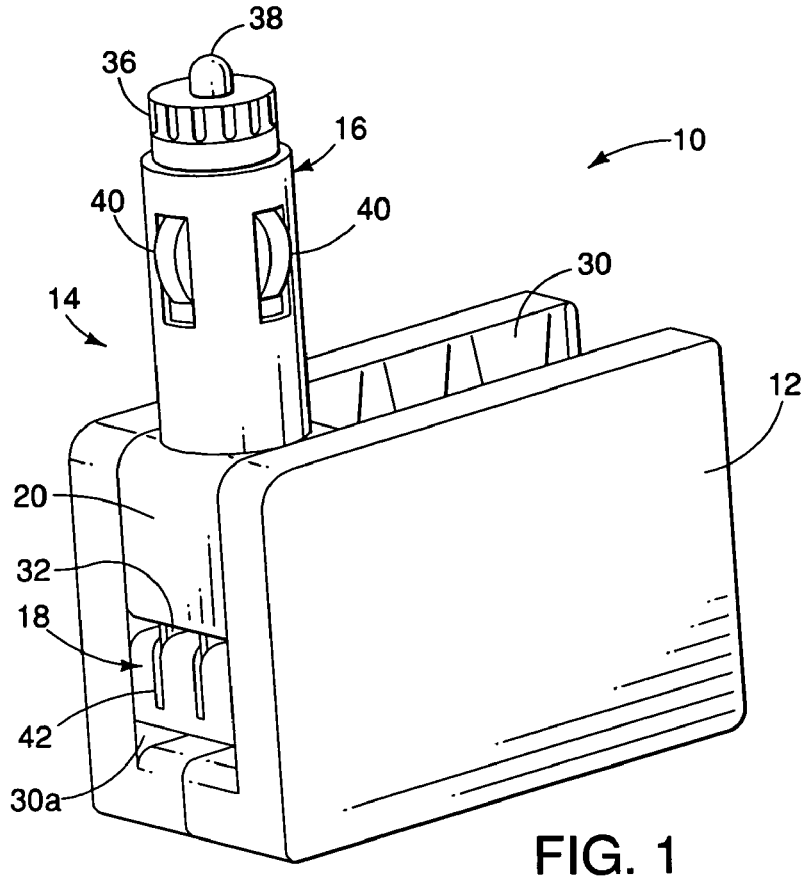
FIG. 1 is a perspective view of an isolated dual AC-DC plug, particularly illustrating the DC connector in a position to be used.

Turning now to the drawings and particularly FIG. 1, a preferred embodiment of the plug is indicated generally at 10 and includes a housing 12, a box shaped connector body, indicated generally at 14, which is pivotable relative to the housing 12 and includes a DC connector portion 16 on one end of the body 14, and an AC connector portion 18 located on the opposite end portion and an intermediate pivot portion 20, that is located between the DC and AC connector portions 16 and 18.

Figure 6:
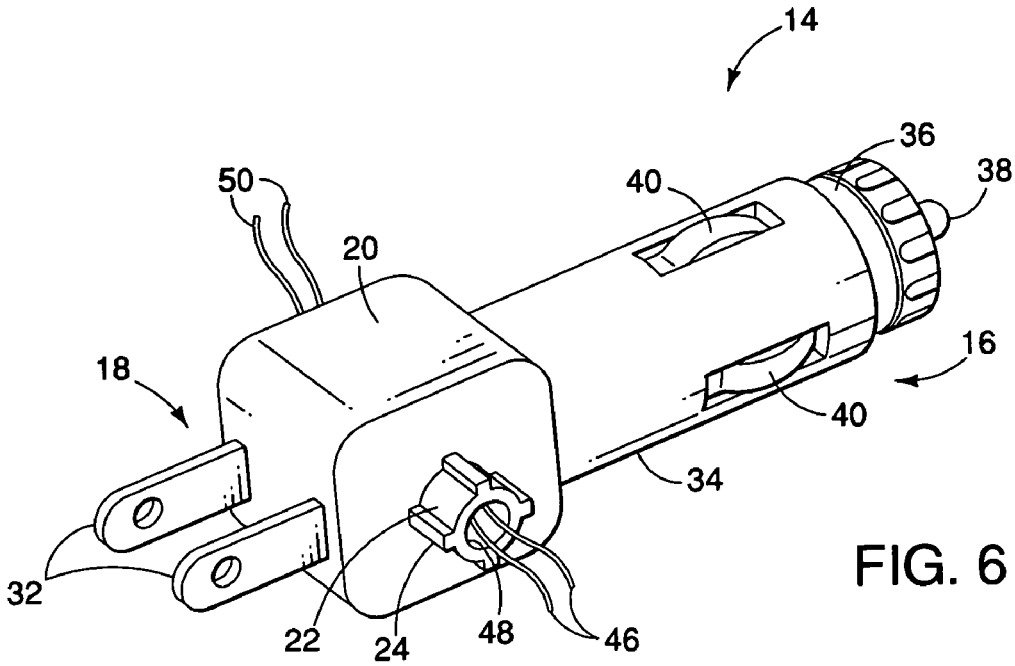
FIG. 6 is a perspective view of the plug body portion of the plug shown in FIGS. 1-5.
Figure 7:
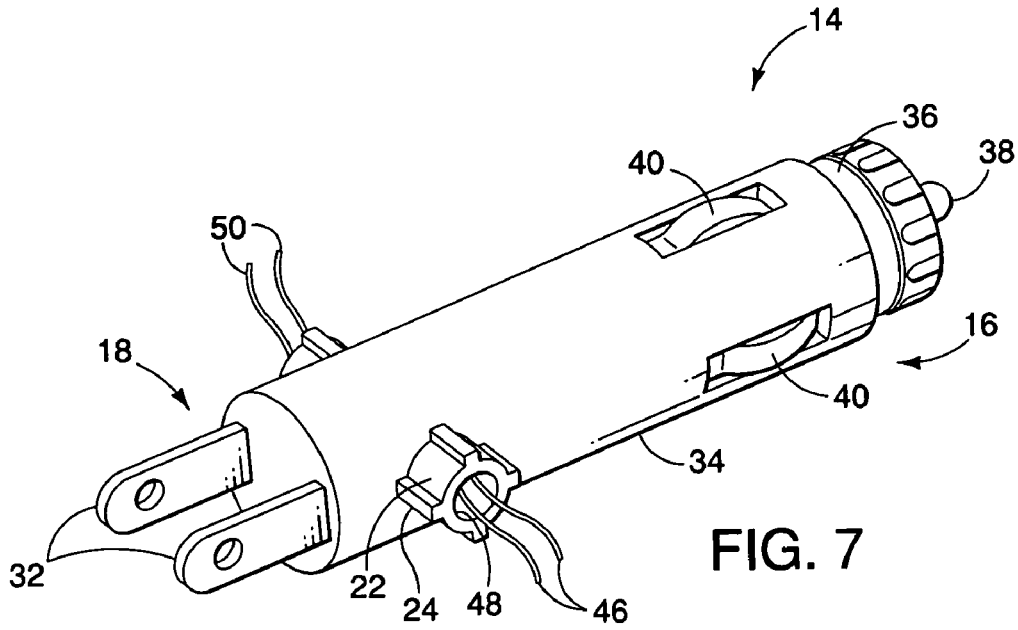
FIG. 7 is a perspective view of an alternative embodiment of the plug body portion.

As is best shown in FIG. 6, the connector body 14 has the intermediate portion 20 provided with a pair of generally cylindrical extensions 22 which fit into apertures (not shown) of the housing 12 thereby making the body portion 14 pivotable therein. Each of the extensions 22 has a number of elongated ridges 24 that cooperate with a retention structure within the housing 12 to hold the body in one of its two preferred orientations during use. In this regard, in FIG. 1, the DC connector 16 is shown extending from the housing adapted to be used by being inserted into a DC receptacle such as a cigarette lighter socket of the type shown in FIG. 9 which has a positive connector pad 24 located in the center of the bottom of the socket recess and a negative preferably metal cylinder 26. The receptacle is typically connected to the battery of the motor vehicle or boat or other DC source. An alternative embodiment of the body portion 14' is shown in FIG. 7, which is functionally equivalent to the embodiment of FIG. 6, except that the shape of the intermediate portion is not box-like, but is cylindrically shaped. Because it is functionally equivalent, it is not described in any detail.

Figure 2:
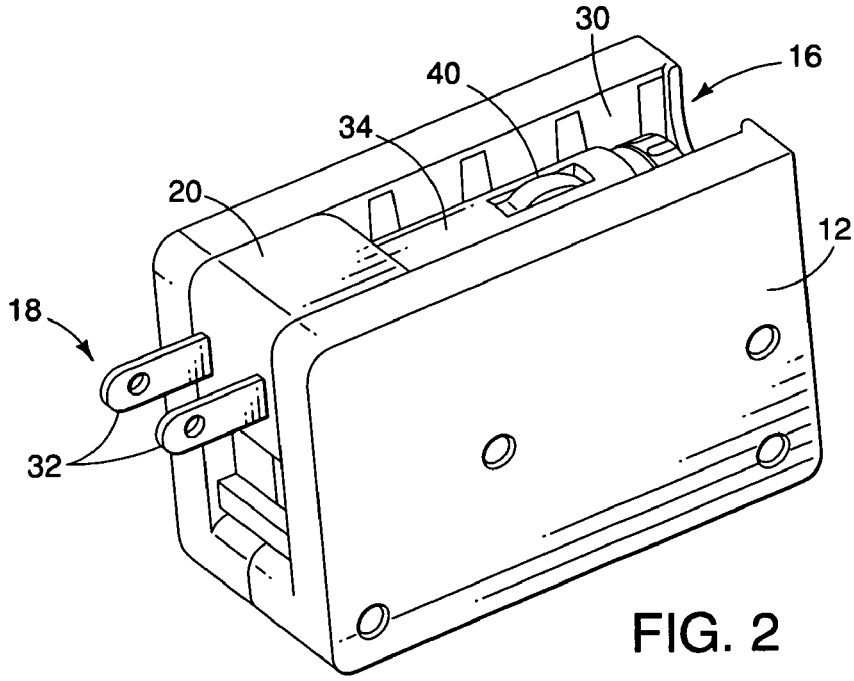
FIG. 2 is a perspective view of the isolated dual AC-DC plug shown in FIG. 1, particularly illustrating the AC connector in a position to be used.
Figure 3:
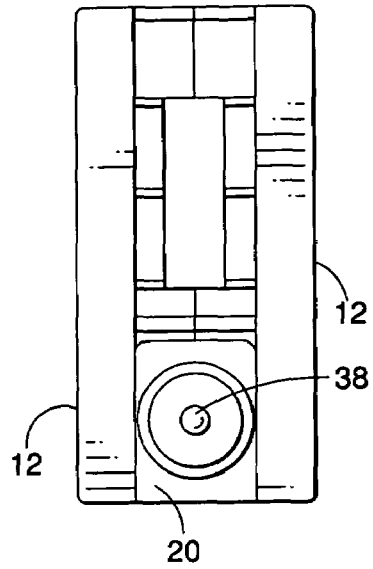
FIG. 3 is an end view of the plug of FIGS. 1 and 2, illustrating the DC connector in position to be used.
Figure 4:
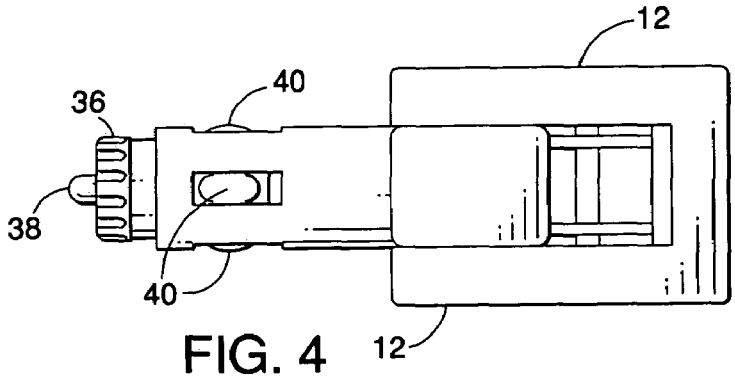
FIG. 4 is a top view of the plug shown in FIG. 3.
Figure 5:
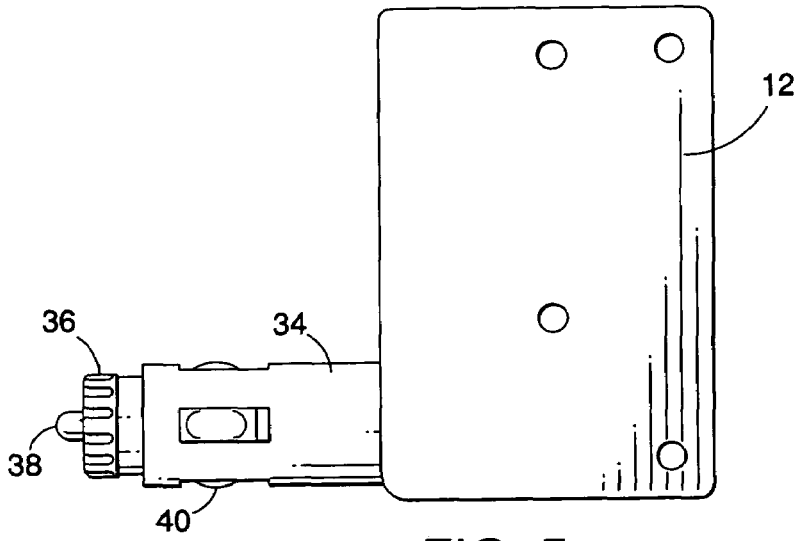
FIG. 5 is a side view of the plug shown in FIG. 3.
Figure 8:
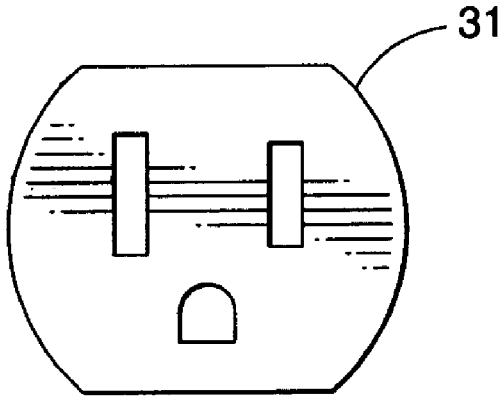
PRIOR ART FIG. 8
FIG. 8 is a plan view of a common domestic electrical AC outlet.

The position of the DC connector in FIG. 1 is vertical relative to the housing as shown and it can rotate between this position and a second position as shown in FIG. 2 where the DC connector 16 fits within a recess 30 and is therefore unusable. However, in this position the AC connector portion 18 is exposed so that it can be inserted into a conventional electrical outlet 31 such as that shown in FIG. 8.

Figure 9:
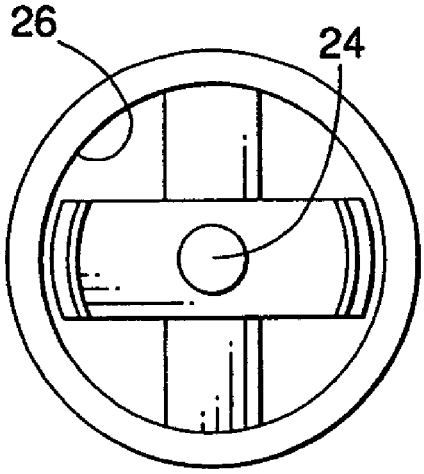
PRIOR ART FIG. 9
FIG. 9 is a plan view of a DC cigarette lighter or auxiliary socket of the type used in motor vehicles.

As is most clearly illustrated in FIG. 6, the electrical connector 18 has a pair of prongs 32 that are configured to connect to the neutral and live conductors of an AC source. The DC connector 16 has a generally cylindrical elongated portion 34 with a reduced diameter end portion 36 from which a positive connector 38 extends, with the connector 16 also having one or more side electrodes 40 that are preferably metallic and flexible or flexibly mounted so that they can retract and extend toward the side of the socket and reliably contact the negative electrode 26 as shown in FIG. 9.

The housing 12 preferably has the recess 30 extending along the top of the housing 12 as shown in FIG. 1, and also extends along the end 30*a* where the AC connector 18 is located. When the DC connector is exposed as shown in FIG. 1, the housing 12 preferably has a pair of slots 42 sized to receive the blades or prongs 32 of the AC connector so that they are substantially retracted or hidden and are unavailable for use. The depth of the slots 42 can be appropriately sized so that the narrow edges of the blades 32 will contact the housing and limit rotation of the plug body so that it cannot move past the vertical position as shown in FIG. 1. Similarly, the depth of a portion of the slot 30 which receives the DC connector 16 is preferably such that the DC connector 16 is substantially horizontal as shown in FIG. 2 when it is fully retracted.

The blades 32 of the AC connector portion 18 are preferably connected to wires 46 and extend from an opening 48 in the illustrated near extension 22 that are then extended by an electrical cord or other suitable conductive arrangement to a device to be connected to. Also, the DC connector portion 16 is similarly connected to wires 50 that run through a similar opening in an extension 22 located on the opposite side of the intermediate portion 20 for connection to a device to be connected to. It should be understood that there are other paths in which electrical connections may be made than those shown.

While various embodiments of the present invention have been shown and described, it should be understood that other modifications, substitutions and alternatives are apparent to one of ordinary skill in the art. Such modifications, substitutions and alternatives can be made without departing from the spirit and scope of the invention, which should be determined from the appended claims.

Various features of the invention are set forth in the following claims.

What is claimed is:

1. Apparatus for selectively connecting to sources of AC and DC electrical power, comprising:

a housing;

a first connector attached to said housing for connecting to a DC source of electrical power;

a second connector attached to said housing for connecting to an AC source of electrical power;

said first and second connectors being configured to enable only one of said connectors to be used at the same time.

2. Apparatus as defined in claim 1 wherein said first connector comprises a generally cylindrical elongated plug body having a positive electrode on the outer end thereof and at least one negative electrode on the side of said elongated plug body, said first connector being configured to be plugged into a socket of the type provided for cigarette lighters in many motor vehicles.

3. Apparatus as defined in claim 1 wherein said second connector comprises a domestic AC power plug having at least a live blade and a neutral blade spaced from one another and configured to be inserted into an electrical outlet.

4. Apparatus as defined in claim 1 wherein said first and second connectors are coupled together and are movable relative to said housing so that only one connector can be used at the same time.

5. Apparatus as defined in claim 4 wherein said first and second connectors are pivotable between first and second positions relative to said housing, wherein only said first connector is usable in said first position and only said second connector is usable in said second position.

6. Apparatus as defined in claim 5 wherein said first and second connectors are connected together in an elongated configuration, with each connector being on an end portion thereof, said configuration having a pivot portion for connection to said housing, and being pivotable relative to said housing.

7. Apparatus as defined in claim 6 wherein said housing includes at least one recess that is configured to receive a substantial portion of said first and second connectors whereby when said connectors are is in said first position, said second connector is in one of said recesses in an unusable position, and when said connectors are in said second position, said first connector is in one of said recesses in an unusable position.

8. Apparatus as defined in claim 1 wherein each of said connectors has a pair of electrical conductors connected thereto that extend from said housing for connection to a device.

9. Apparatus as defined in claim 8 wherein said pivot portion has an opening therein through which said conductors pass.

10. An electrical connecting plug for selectively interconnecting a device to either an AC or DC source of power, comprising:

a housing having at least one recess;

an elongated connector body connected to said housing located in said recess and having a DC connector on one end portion and an AC connector on an opposite end portion and an intermediate pivot portion that permits said connector body to pivot between first and second positions relative to said housing;

said DC connector being exposed and capable of being connected to a DC source when said connector body is in said first position;

said AC connector being exposed and capable of being connected to an AC source when said connector body is in said second position.

11. An electrical connecting plug as defined in claim 10 wherein said DC connector comprises a generally cylindrical elongated plug body having a positive electrode on the outer end thereof and at least one negative electrode on the side of said elongated plug body, said first connector being configured to be plugged into a socket of the type provided for cigarette lighters in many motor vehicles.

12. An electrical connecting plug as defined in claim 10 wherein said AC connector comprises a domestic AC power plug having at least a live blade and a neutral blade spaced from one another and configured to be inserted into an electrical outlet.

13. An electrical connecting plug for selectively interconnecting a device to either an AC or DC source of power, comprising:

a housing having at least one recess;

an elongated connector body connected to said housing located in said recess and having a DC connector portion and an AC connector portion on opposite ends of the body and an intermediate portion that is secured in said connector body in a manner that permits said body to pivot between first and second positions relative to said housing;

said DC connector comprises a generally cylindrical elongated plug body having a positive pin on the outer end thereof and at least one negative pin on the side of said elongated plug body, said DC connector being configured to be plugged into a cylindrical DC source socket;

said AC connector comprises a domestic AC power plug having at least a live prong and a neutral prong spaced from one another and configured to be inserted into an electrical outlet;

said DC and AC connectors being configured to enable only one of said AC and DC connectors to be sufficiently exposed at the same time to be able to be plugged into its corresponding source.

14. An electrical connecting plug as defined in claim 13 wherein said electrical outlet is a standard 110-120 volt receptacle having at least a recess for receiving said live prong and a recess for receiving a neutral prong.

15. An electrical connecting plug as defined in claim 13 wherein said cylindrical DC source socket has a positive polarity connecting pad in the bottom central portion thereof and a negative polarity connecting portion located on the interior of said cylindrical socket.

* * * * *